United States Patent [19]

Pauley

[11] 4,103,669

[45] Aug. 1, 1978

[54] FIREPLACE HEAT EXCHANGER ASSEMBLY

[76] Inventor: Eugene E. Pauley, 45 Coral Dr., Belleville, Ill. 62221

[21] Appl. No.: 692,570

[22] Filed: Jun. 3, 1976

[51] Int. Cl.[2] ..... F24B 7/00

[52] U.S. Cl. ..... 126/121; 126/131

[58] Field of Search ..... 126/120, 121, 130, 131

[56] References Cited

U.S. PATENT DOCUMENTS

| | | | |
|---|---|---|---|
| 1,350,495 | 8/1920 | Hagenbuch | 126/121 |
| 1,383,506 | 7/1921 | Westerlund | 126/121 |
| 1,434,083 | 10/1922 | Brander | 126/121 |
| 1,681,449 | 4/1928 | Walters | 126/121 |
| 2,787,997 | 4/1957 | Asbury | 126/121 |
| 3,190,282 | 6/1965 | Bauer | 126/121 |

FOREIGN PATENT DOCUMENTS

| | | | |
|---|---|---|---|
| 661,824 | 1929 | France | 126/121 |
| 74,394 | 1948 | Norway | 126/121 |
| 672,437 | 1952 | United Kingdom | 126/121 |
| 785,699 | 1957 | United Kingdom | 126/121 |

*Primary Examiner*—Ronald C. Capossela
*Attorney, Agent, or Firm*—Cohn, Powell & Hind

[57] ABSTRACT

A fireplace heat exchanger assembly having a conduit that includes a first passage communicating with an air inlet located outwardly of a fireplace and extending rearwardly across the top of the fireplace, and a second passage communicating with the first passage at the rear of the fireplace and extending forwardly across the top of the fireplace for communication with an air outlet located outwardly of the fireplace. A blower introduces air into the air inlet, passes the air through the first and second passages, and discharges the air through the air outlet. More particularly, the conduit includes a heat exchanger box of relatively smaller height than width and length, the box being provided with laterally spaced and enclosed slots therethrough to provide the first passage between the slots, and to provide a pair of second passages laterally outward of the slots, the slots terminating in spaced relation to the rear of the box to place the first and second passages in communication. In one embodiment, the heat exchanger box has angularly related box portions through which the enclosed slots extend, so that the first and second passages are disposed at an angle to the vertical at the rear of the fireplace, and the transverse passage interconnects the first and second passages at the bottom, rear of the fireplace. Further, the conduit includes a duct frame disposed externally at the top and sides of the fireplace through which the first and second passages communicate respectively with the air inlet and air outlet.

4 Claims, 10 Drawing Figures

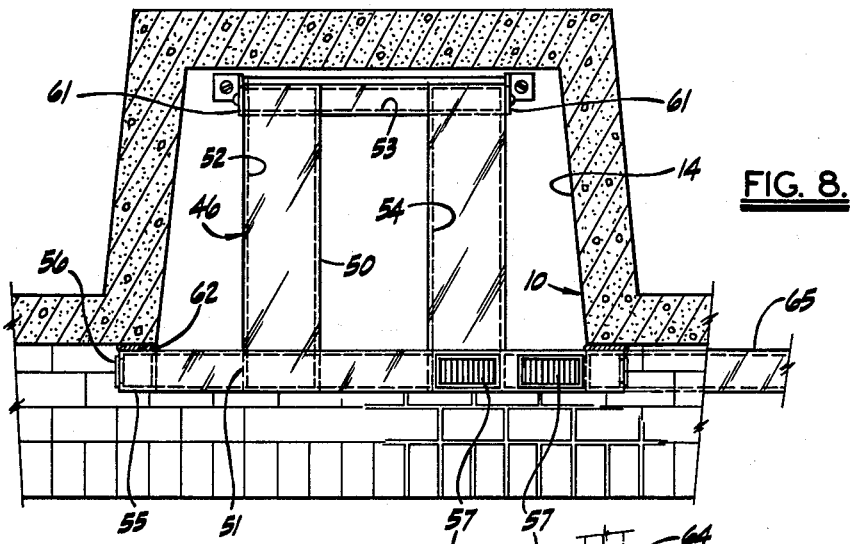
FIG. 8.
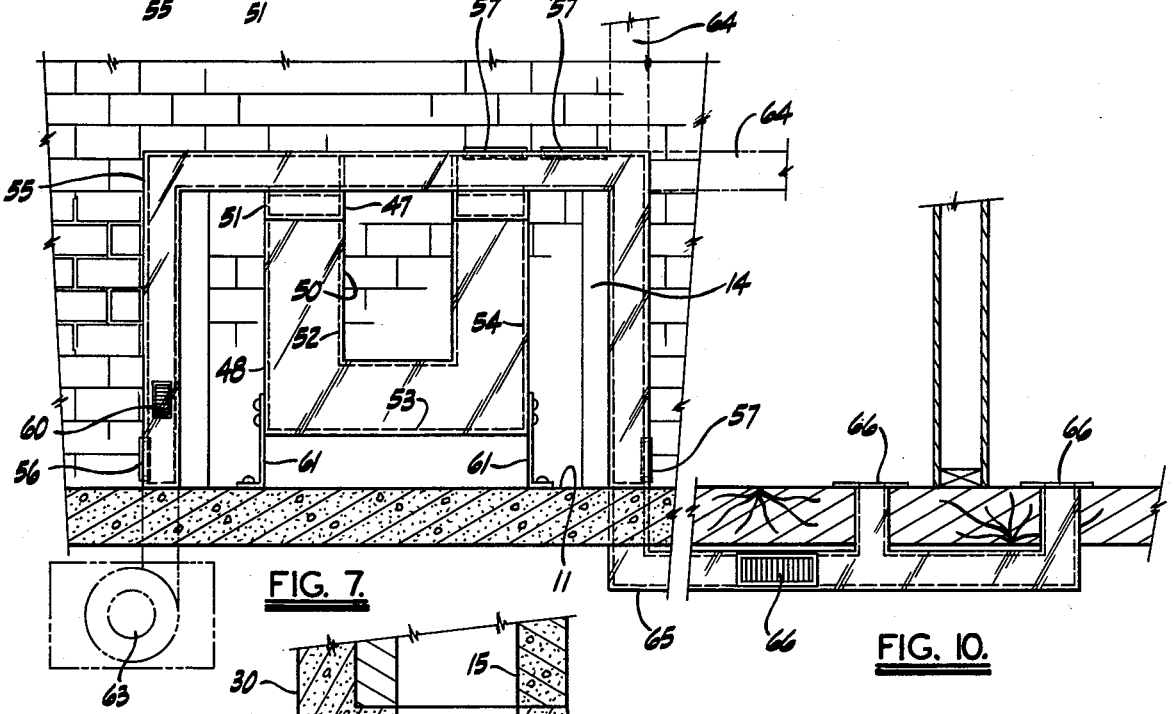
FIG. 7.
FIG. 10.
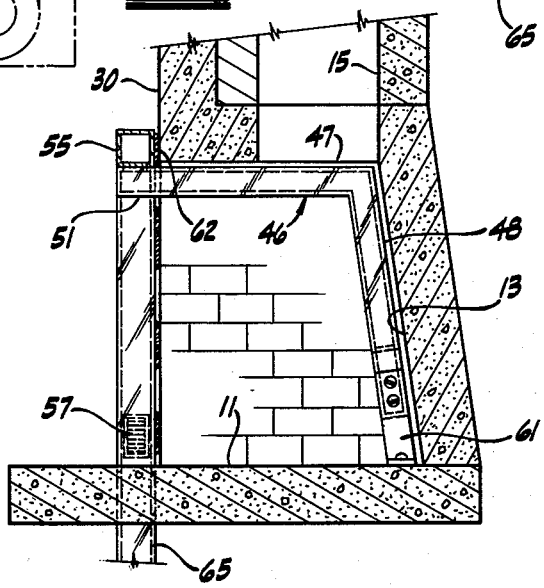
FIG. 9.

FIREPLACE HEAT EXCHANGER ASSEMBLY

BACKGROUND OF THE INVENTION

This invention relates generally to an improved fireplace heat exchanger assembly, and more particularly to a device of this type that achieves more efficient heating of the air passing through the heat exchanger box, and a more efficient discharge of the heated air.

Some of the heretofore conventional heat exchanger devices adapted for use in a fireplace were quite complicated in structure and were attached to or built into the walls of the fireplace, thereby creating considerable difficulty in installation, and in some cases created undesirable pressure on the fireplace walls. Other such devices of this type constituted a part of the grate supporting and underlying the combustible material. Still other devices of this type either obstructed easy access to the combustible material or had an inefficient arrangement and disposition of air tubes in the fireplace relative to the combustible material.

SUMMARY OF THE INVENTION

The present fireplace heat exchanger assembly is a self-contained portable unit that may be used in any fireplace. Because it is independently supported, the heat exchanger does not create any pressure on the fireplace walls. The disposition of the heat exchanger unit in the fireplace over and above the combustible material, and the arrangement of the air passages in the heat exchange unit provides unobstructed access to the combustible material, and achieves a highly efficient heat transfer as the passages extend more than once over the flames.

The heat exchanger assembly includes a conduit that is held at the top of the fireplace by a support. The conduit has a first passage communicating with an air inlet located outwardly of the fireplace and extending rearwardly across the top of the fireplace, and a second passage communicating with the first passage at the rear of the fireplace and extending forwardly across the top of the fireplace for communication with an air outlet also located outwardly of the fireplace. A blower introduces air into the air inlet, passes the air through the first and second passages, and discharges the air through the air outlet.

More particularly, the conduit includes a heat exchanger box of relatively smaller height than width and length, the box being provided with an enclosed slot therethrough to provide the first and second passages. In one embodiment, the box is provided with laterally spaced and enclosed slots therethrough to provide the first passage between the slots, and to provide a pair of second passages laterally outwardly of the slots, the slots terminating in spaced relation at the rear of the box to place the first and second passages in communication through a transverse passage.

The heat exchanger assembly of one embodiment can be a self-contained portable unit that may be used in any fireplace. It does not need to be attached to the floor, walls or top of the fireplace. It can be moved to another fireplace by just adjusting four leveling legs.

In an embodiment of the heat exchanger assembly, the first passage extends rearwardly across the top of the fireplace and then extends downwardly and rearwardly at an angle to the vertical at the rear of the fireplace, while the second passage extends upwardly and forwardly at an angle to the vertical at the rear of the fireplace and then extends forwardly across the top of the fireplace. A transverse passage interconnects the first and second passages at the bottom rear of the fireplace. The above described structural arrangement of the air passages is provided by a heat exchanger box having angularly related top and rear portions. The angularly inclined rear box portion is effective in its contact with the flame.

The conduit includes a duct frame disposed externally at the top and sides of the fireplace. The first and second passages communicate respectively with the air inlet and air outlet through the duct frame. An auxiliary duct is interconnected with the duct frame downstream of the second passage for delivering heated air to a remote location. In this structural arrangement, the blower is interconnected with the duct frame.

In an embodiment of the the heat exchanger assembly, the heat exchanger box provides the first and second passages and a transverse passage interconnecting the first and second passages at the rear of the box, while the first and second passages are interconnected with the duct frame at the front of the box. The air inlet communicates with the duct frame upstream of the first passage, and the air outlet communicates with the duct frame downstream of the second passage.

BRIEF DESCRIPTION OF THE DRAWINGS

FIG. 7 is a front elevational view of another embodiment of the heat exchanger assembly mounted in the fireplace;

FIG. 8 is a horizontal cross section of the fireplace, and illustrates the heat exchanger assembly of FIG. 7 in top plan;

FIG. 9 is a vertical cross section of the fireplace, and illustrates the heat exchanger assembly of FIG. 7 in side elevation; and FIG. 10 is a fragmentary cross-sectional view of the floor in FIG. 7, and illustrates delivery of heated air from the heat exchanger assembly to a remote location.

DESCRIPTION OF THE PREFERRED EMBODIMENTS

Figure 2:
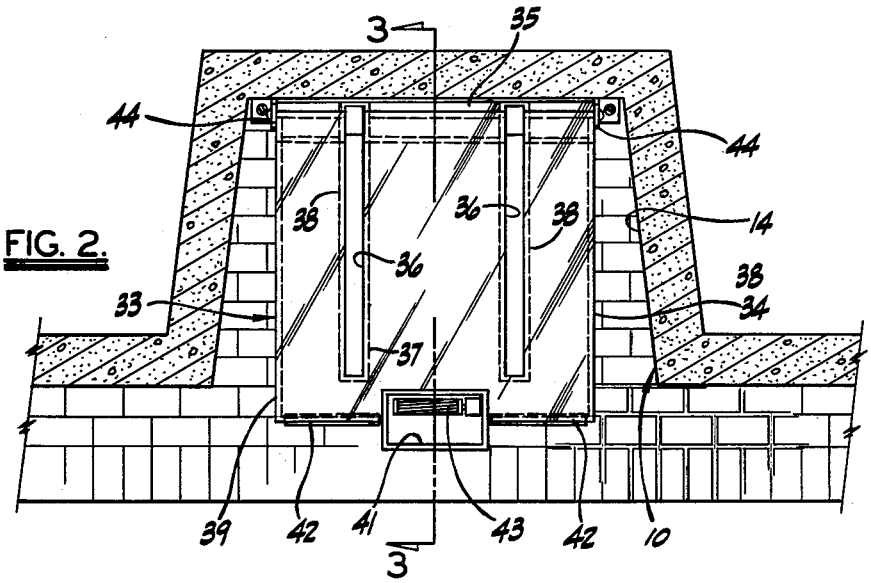
FIG. 2 is a horizontal cross-sectional view through the fireplace, and illustrates a top plan of the heat exchanger assembly.

Referring now by characters of reference to the drawings, it will be understood that the fireplace 10 is of conventional construction having a floor 11, a top wall 12, a rear wall 13 extending downwardly and rearwardly from the top wall 12 to the floor 11 at an angle to the vertical, and inwardly converging side walls 14. A flue 15 leading to a chimney (not shown) communicates with the fireplace 10 through the top wall 12.

Figure 5:
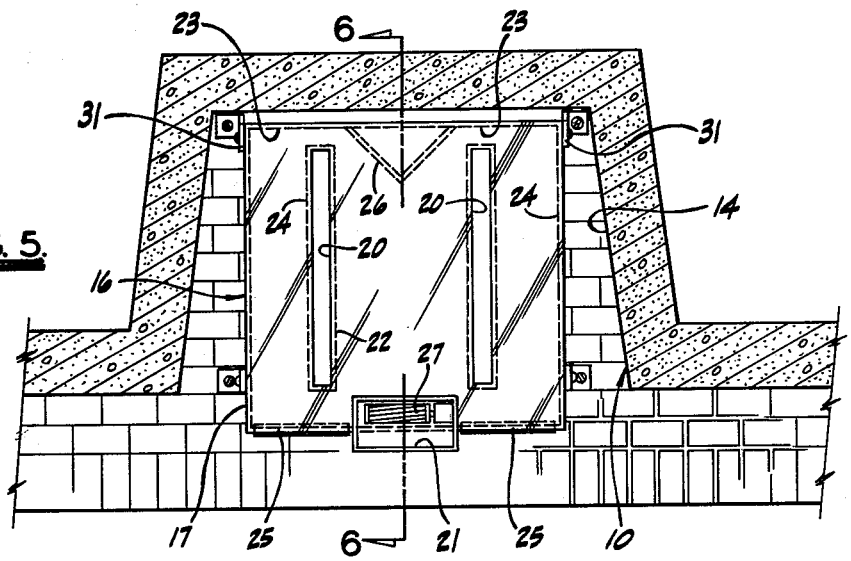
FIG. 5 is a horizontal cross-sectional view of the fireplace, and illustrates the heat exchanger assembly of FIG. 4 in top plan.
Figure 4:
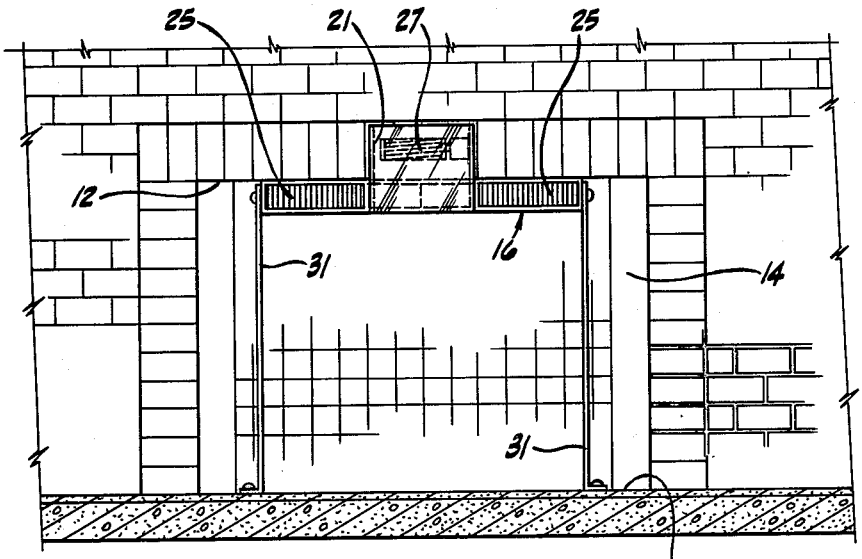
FIG. 4 is a front elevational view of another embodiment of the heat exchanger assembly mounted in the fireplace.
Figure 6:
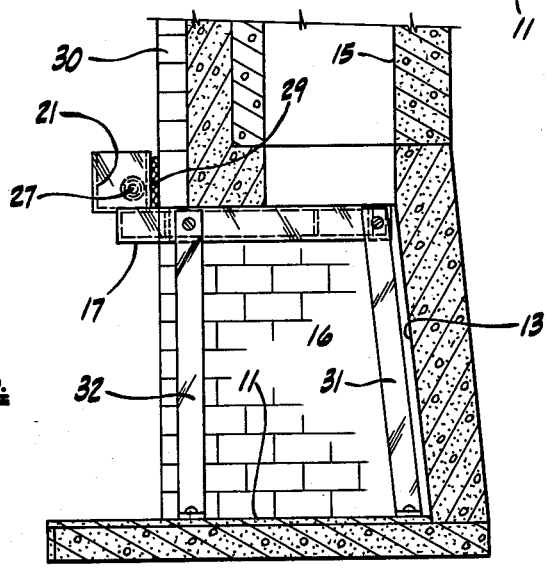
FIG. 6 is a cross section of the fireplace as taken on line 6—6 of FIG. 5, and shows the heat exchanger assembly in side elevation.

In the embodiment of FIGS. 4–6, the conduit of the heat exchanger assembly includes a box 16 of relatively smaller height than width and length that is positioned closely adjacent the top wall 12 of the fireplace 10. The front portion 17 of the heat exchanger box 16 extends forwardly out of the fireplace.

Formed in and through the heat exchanger box 16 are a pair of substantially parallel, laterally spaced and enclosed slots 20, the elongate slots 20 extending substantially the depth of the fireplace. The front box portion 17 is provided with an air inlet 21 that communicates with a first passage 22 in the box defined by and located between the slots 20. The first passage 22 extends rearwardly across the top of the fireplace. The slots 20 terminate in spaced relation to the rear of the exchanger box to provide a pair of transverse passages 23 that interconnect the first passage 22 with a pair of second passages 24 defined by and located laterally outwardly of the slots 20. The second passages 24 extend forwardly across the top of the fireplace and communicate with air outlets 25 provided in the front box portion 17 at each side of the air inlet 21. A triangularly shaped baffle 26 is disposed at the rear of the exchanger box 16 and in the first passage 22, the baffle 26 deflecting airflow from the first passage 22 laterally into the transverse passages 23.

A blower 27, provided by a motor-fan, is located at the air inlet 21 for introducing air into the air inlet 21, passing the air through the first passage 22, the transverse passages 23, the second passages 24, and discharging the air through the air outlets 25.

The heat exchanger box 16 is located in the fireplace 10 closely adjacent the top wall 12 with its front portion 17 projecting outwardly of the fireplace. The air inlet 21 is secured by an adhesive connection 29 to the front face 30 to facilitate location and support of the exchanger box 16. In addition, the exchanger box 16 is held in position by a pair of support legs 31 attached to opposite sides at the rear of the box 16, and a pair of support legs 32 attached to opposite sides near the front portion 17 of the box 16, the support legs 31 and 32 being preferably attached to the floor 11 of the fireplace 10. Preferably, the exchange box 16 is located just below the flue 15.

When the heat exchanger assembly is installed, and a fire is started in the fireplace 10 immediately below the exchanger box 16, the flames and the heat from the combustible material will contact the exchanger box 16 and heat the air passing therethrough. The gases from the combustible material will pass upwardly into the flue 15 around the exchanger box 16 and through the slots 20, and will heat the air passing through the box 16. The blower 27 is energized and forces air into the air inlet 21 and into the first passage 22 as the air makes a first pass rearwardly over the flames. This heated air in the first passage 22 is then deflected into the rear transverse passages 23 and into the second passages 24. The air moves forwardly along the second passages 24 across the top of the fire again, and is discharged out into the room through the air outlets 25.

Figure 1:
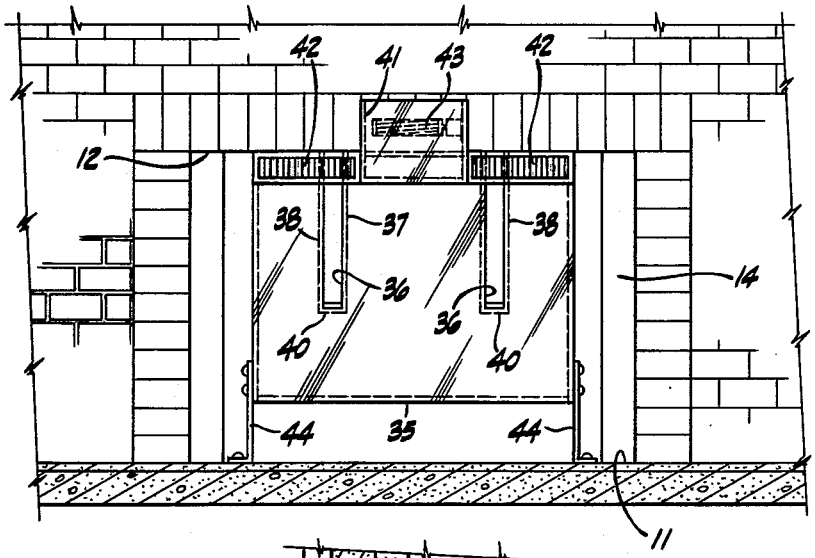
FIG. 1 is a front elevational view of the heat exchanger assembly mounted in a fireplace.
Figure 3:
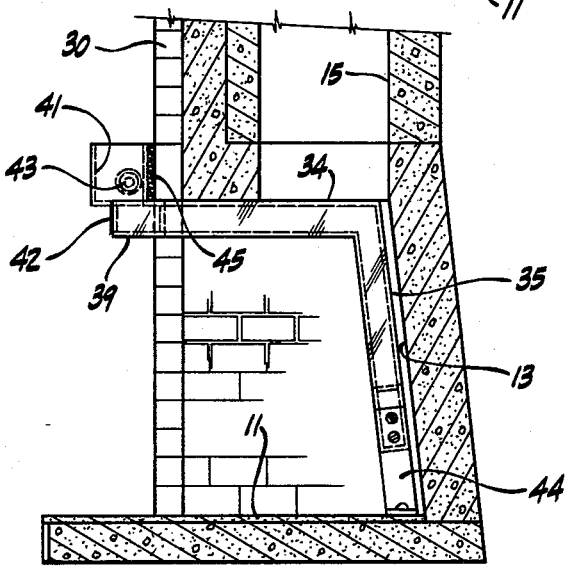
FIG. 3 is a cross-sectional view taken on line 3—3 of FIG. 2, and shows the heat exchanger assembly in side elevation.

In the embodiment of FIGS. 1–3, the conduit includes a heat exchange box 33 having angularly related top and rear portions 34 and 35. The top box portion 34 is disposed closely adjacent the top wall 12 of the fireplace 10 and includes a front portion 39 that projects outwardly at the top of the fireplace. The rear box portion 35 extends rearwardly and downwardly at an angle to the vertical closely adjacent the rear wall 13 of the fireplace.

A pair of laterally spaced and enclosed elongate slots 36 are provided through both of the angularly related box portions 34 and 35 to provide a first passage 37 therebetween, and a pair of second passages 38 laterally outwardly of the slots 36. The slots 36 terminate in spaced relation to the rear, bottom of the box 33 to provide a pair of transverse passages 40, each of which interconnects the first passage 37 with one of the second passages 38.

An air inlet 41 is provided in the front portion 39 and communicates with the first passage 37. Air outlets 42 are provided in the front box portion 39, one on each side of the air inlet 41 and communicating with one of the second passages 38. A blower 43 introduces air into the air inlet 41.

To install the heat exchanger assembly of FIGS. 1–3, the box portion 34 is located at the top of the fireplace and the box portion 35 is angularly related to the vertical near the rear wall 13 of the fireplace. The box portions 34–35 are maintained in position by a pair of adjustable support legs 44 attached to opposite sides of the inclined box portion 35 and seating on the fireplace floor 11, and by an adhesive attachment 45 that secures the front box portion 39 to the front face 30.

In operation, the blower 43 introduces air into the first passage 37 through the air inlet 41, the air traveling rearwardly over the flames of the combustible material in the fireplace as it moves through the first passage 37 in the box portions 34 and 35. Then, the air divides into the transverse passages 40 and passes into the second passages 38. Again, the air passes over the flames as it travels forwardly in the second passages 38 in the box portions 34 and 35, and the air is then discharged through the air outlets 42.

The fireplace heat exchanger assembly of FIGS. 7–9 includes a conduit having a heat exchanger box 46 with a top horizontally disposed box portion 47 and a rearwardly and downwardly inclined box portion 48. The exchanger box 46 is provided with a slot 50 extending rearwardly and longitudinally of the upper box portion 47 and extending partially into the inclined box portion 48. The upper box portion 47 includes a front box portion 51 that extends outwardly of the fireplace. The slot 50 defines a first passage 52 that extends rearwardly in the upper box portion 47, and thence rearwardly and downwardly into the inclined box portion 48. The first passage 52 communicates with a transverse passage 53 at the bottom, rear of the incline box portion 48. The transverse passage 53 then communicates with a second passage 54 in the inclined box portion 48, the second passage 54 extending upwardly and forwardly in the inclined and top box portions 48–47 respectively.

The conduit also includes a duct frame 55 that is disposed externally of the top and sides of the fireplace, the duct frame 55 communicating laterally with the front box portion 51. An inlet 56 can be provided in the duct frame 55 at one side of the fireplace which communicates with the first passage 52. Outlets 57 can be provided in the top of the front box portion 51 or in the duct frame 55 at the opposite side of the fireplace, such outlets 57 communicating with the second passage 54. A blower 60 can be located in the duct frame 55 adjacent the air inlet 56 for introducing air into the duct frame for passage through the first passage 52, transverse passage 53, and second passage 54, and thence through the outlets 57.

To install the heat exchanger assembly of FIGS. 7–9, the horizontal box portion 47 is located closely adjacent to the top wall 12 of the fireplace and the inclined box portion 48 is located closely adjacent to the rear wall 13 of the fireplace. It is supported by a pair of adjustable support legs 61, one of which is attached to each side of the rear, bottom of the box portion 48 and secured to the fireplace floor 11. The duct frame 55 is located about the periphery of the fireplace opening and is secured by an adhesive connection 62 to the front wall 30.

In operation, the blower 60 introduces air into the duct frame 55 through the air inlet 56, and passes the air from the duct frame 55 into the first passage 52 whereby the air passes rearwardly in the box portions 47 and 48 over the top of the flame of the combustible material. Then, the air passes from the first passage 52 into the transverse passage 53 at the bottom, rear portion of the box portion 48, and thence passes into the second passage 54 whereby the air passes forwardly in the box portions 48 and 47 again over the top of the flame, and into the duct frame 55. The air is then discharged through the provided air outlets 57.

As is indicated by phantom lines in FIG. 7, a blower 63 can be connected operatively to the duct frame 55 from a remote location, as for example below the floor. In addition, additional air directional tubing 64 can be operatively connected to the duct frame 55 for delivering air to other remote locations for heating purposes. FIGS. 7 and 10 indicate another possible manner of heating remote locations. For example, a tubing 65 can be operatively connected to the duct frame 55 through the floor and be provided with a plurality of registers or air outlets 66 in the space below the floor or in different rooms.

It will be also understood, that the duct frame 55 as shown in FIGS. 7–9 can also be utilized with the heat exchanger assemblies disclosed in FIGS. 1–3 and FIGS. 4–6. This can be easily accomplished by attaching the duct frame 55 to the opposite sides of the front box portions 39 of FIGS. 1–3 and 17 of FIGS. 4–6.

The heat exchanger assemblies operate on positive air pressure, the pressure in the heat exchanger being greater when the fan is on than outside pressure. This pressure differential makes it impossible for air from the firebox to enter the heat exchanger. Because of the heat exchanger design, it will never create a gravity flow.

I claim as my invention:

1. In a fireplace heat exchanger assembly:

(a) a conduit having an air inlet and an air outlet located outwardly of the fireplace, the conduit including:

(1) a first passage communicating with the air inlet and extending rearwardly across the top of the fireplace, and (2) a second passage communicating with the first passage at the rear of the fireplace and extending forwardly across the top of the fireplace for communication with the air outlet, (b) support means for holding the conduit at the top of the fireplace, (c) blower means introducing air into the air inlet, passing the air through the first and second passages, and discharging the air through the air outlet, (d) the conduit including a heat exchanger box of relatively smaller height than width and depth, the box being provided with laterally spaced and enclosed slots extending therethrough and extending rearwardly to provide the first passage between the slots communicating with the air inlet, and to provide a pair of second passages laterally outward of the slots communicating with the air outlet, the slots terminating in spaced relation to the rear of the box to provide a transverse passage placing the first and second passages in communication.

2. In a fireplace heat exchanger assembly:

(a) a conduit having an air inlet and an air outlet located outwardly of the fireplace, the conduit including:

(1) a first passage communicating with the air inlet and extending rearwardly across the top of the fireplace, and (2) a second passage communicating with the first passage at the rear of the fireplace and extending forwardly across the top of the fireplace for communication with the air outlet, (b) support means for holding the conduit at the top of the fireplace, (c) blower means introducing air into the air inlet, passing the air through the first and second passages, and discharging the air through the air outlet, (d) the first passage extending downwardly and rearwardly at an angle to the vertical at the rear of the fireplace, (e) the second passage extending upwardly and forwardly at an angle to the vertical at the rear of the fireplace, and (f) a transverse passage operatively interconnecting the first and second passages at the bottom, rear of the fireplace.

3. A fireplace heat exchanger assembly as defined in claim 2, in which:

(g) the conduit includes a heat exchanger box having angularly related portions of relatively smaller height than width and length, the box being provided with an enclosed slot through both of the angularly related box portions to provide the first, second and transverse passages.

4. A fireplace heat exchanger assembly as defined in claim 2, in which:

(g) the conduit includes a heat exchanger box having angularly related portions of relatively smaller height than width and length, the box being provided with laterally spaced and enclosed slots through both of the angularly related box portions to provide the first passage between the slots and to provide a pair of second passages laterally outward of the slots, the slots terminating in spaced relation to the rear, bottom of the box to provide a pair of the transverse passages each of which interconnects the first passage with one of the second passages.

* * * * *